US007364148B2

(12) United States Patent
Herbert et al.

(10) Patent No.: US 7,364,148 B2
(45) Date of Patent: Apr. 29, 2008

(54) SHEET COMBINING DEVICE AND A METHOD FOR COMBINING SHEETS

(75) Inventors: Burkard Otto Herbert, Würzburg (DE); Stefan Wander, Helmstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 290 days.

(21) Appl. No.: 10/539,810

(22) PCT Filed: Dec. 5, 2003

(86) PCT No.: PCT/DE03/03993

§ 371 (c)(1),
(2), (4) Date: Jun. 20, 2005

(87) PCT Pub. No.: WO2004/054914

PCT Pub. Date: Jul. 1, 2004

(65) Prior Publication Data

US 2006/0144507 A1 Jul. 6, 2006

(30) Foreign Application Priority Data

Dec. 18, 2002 (DE) ..... 102 59 655
May 10, 2003 (DE) ..... 103 21 021
Jun. 4, 2003 (DE) ..... 103 25 226

(51) Int. Cl.
*B65H 37/04* (2006.01)

(52) U.S. Cl. ..... 270/52.09; 270/5.01; 270/5.02; 270/5.03; 270/40; 270/41; 270/52.07; 493/436; 493/439

(58) Field of Classification Search ..... 270/5.01, 270/5.02, 5.03, 40, 41, 52.07, 52.09; 493/436, 493/439
See application file for complete search history.

(56) References Cited

U.S. PATENT DOCUMENTS 752,807 A * 2/1904 Spalckhaver ..... 270/6
1,709,632 A * 4/1929 Schmidt ..... 270/32
3,808,768 A * 5/1974 Dobbs ..... 53/460

(Continued)

FOREIGN PATENT DOCUMENTS

DE 41 28 797 A1 3/1993

(Continued)

OTHER PUBLICATIONS

"Inline Heftsystem Speedliner," Tolerans.

(Continued)

*Primary Examiner*—Gene O. Crawford
*Assistant Examiner*—Leslie A Nicholson, III
(74) *Attorney, Agent, or Firm*—Jones, Tullar & Cooper P.C.

(57) ABSTRACT

A sheet combining device includes at least one former, at least one longitudinal cutter, and at least two partial web guide routes. A respective partial sheet of partial cut webs can be conveyed on each of the at least two partial web guide routes. These sheets can be combined to form a principal sheet at an exit of the sheet combining device. A stapler is provided on one of the at least two partial web guide routes and is used to staple the partial sheet which is conveyed on that guide route.

3 Claims, 5 Drawing Sheets

U.S. PATENT DOCUMENTS

| | | | | |
|---|---|---|---|---|
| 4,512,845 | A * | 4/1985 | Kobler | 156/548 |
| 4,671,501 | A * | 6/1987 | Fujishiro | 270/21.1 |
| 4,725,050 | A * | 2/1988 | Fujishiro | 270/5.01 |
| 5,230,501 | A * | 7/1993 | Melton | 270/41 |
| 5,303,909 | A | 4/1994 | Maylaender | |
| 5,474,221 | A | 12/1995 | Klinga | |
| 5,503,379 | A | 4/1996 | Michalik et al. | |
| 5,647,949 | A | 7/1997 | Kepert | |
| 5,804,020 | A * | 9/1998 | Akao et al. | 156/251 |
| 6,892,635 | B2 * | 5/2005 | Herbert | 101/225 |
| 6,899,026 | B2 * | 5/2005 | Weis | 101/225 |
| 7,156,019 | B2 * | 1/2007 | Herbert et al. | 101/227 |
| 7,159,512 | B2 * | 1/2007 | Masuch et al. | 101/178 |
| 2005/0093220 | A1 * | 5/2005 | Herbert et al. | 270/5.01 |

FOREIGN PATENT DOCUMENTS

| | | | |
|---|---|---|---|
| DE | 43 26 855 | A1 | 2/1994 |
| DE | 43 44 362 | A1 | 6/1995 |
| DE | 101 06 985 | A1 | 8/2002 |

OTHER PUBLICATIONS

Braun, "Atlas des Zeitungs- und Illustrationsdruckes", Polygraph, 1960.

Walenski, "Der Rollen Offset druck," 1995, Fach Schriften Verlag.

* cited by examiner

SHEET COMBINING DEVICE AND A METHOD FOR COMBINING SHEETS

CROSS-REFERENCE TO RELATED APPLICATIONS

This patent application is the U.S. national phase, under 35 USC 371 of PCT/DE2003/003993, filed Dec. 5, 2003; published as WO 2004/054914 A1 on Jul. 1, 2004; and claiming priority to DE 102 59 655.7, filed Dec. 18, 2002, to DE 103 21 021.0 filed May 10, 2003 and to DE 103 25 226.6, filed Jun. 4, 2003, the disclosures of which are expressly incorporated herein.

FIELD OF THE INVENTION

The present invention is directed to devices for mixing continuous webs, and to a method for mixing continuous webs. The devices include at least one former, at least one longitudinal cutter and at least two guide paths. Each guide path receives a partial continuous web.

The present invention more particularly directed to a mixing device for use with continuous webs which can be used in the printing of newspapers. The mixing device is situated between a printing press and a transverse folding device in order to bring a plurality of imprinted paper webs into an arrangement which is desired for the finished printed product. The present invention, in particular, relates to a mixing device for continuous webs which are suitable for printed products in tabloid format.

BACKGROUND OF THE INVENTION

DE 43 26 855 A1 discloses a mixing device for continuous webs, having a former and two guide paths, on each of which a cut partial web is conducted. One of the partial webs is provided with glue along its path and is subsequently glued together with the second partial web. In another embodiment, two continuous webs run over two formers. One of the continuous webs is stapled by a stapler and the other continuous web is glued in its path before they are both combined in a main continuous web.

A mixing device for continuous webs with at least one former is known from DE 43 44 362 A1. The continuous web leaving the former can be selectively conducted around one or the other side of a further former located underneath.

SUMMARY OF THE INVENTION

The object of the present invention is directed to providing mixing devices for continuous webs, and to a method for mixing continuous webs.

In accordance with the present invention, this object is attained by the provision of a continuous web mixing device with at least one former, at least one longitudinal cutter that is useable to cut a longitudinal web delivered to the former, either before or after the former, and at least two guide paths. Each of these guide paths can receive a partial web coming from the former. These partial webs can be treated separately along each one's guide path. The treated partial webs can be united in a continuous web mixing device. They can also be united with another web coming from a second former.

The advantages to be obtained by the present invention lie, in particular, in that the mixing device for continuous webs permits the production of multi-layered products, and in particular permits the production of tabloid products, in which at least one layer of the product is stapled.

A further advantage of the present invention is that the continuous web mixing device makes do without turning bars.

The costs of the device are reduced because of this elimination of turning bars. Furthermore, drawing webs of material to be processed into the device, prior to its being put into operation, can be accomplished simply and rapidly. Moreover, the elimination of the need to turn the webs reduces the susceptibility of the continuous web mixing device to operational malfunctions.

In this case, the continuous web mixing device can have at least one second former and can also have a guide path for guiding a second partial continuous web from the second former to the outlet. By the use of such a device, a partial continuous web, from the continuous web that was cut apart by the longitudinal cutter, can be mixed with the second partial continuous web from the second former to constitute a first book. The other partial continuous web from the continuous web cut apart by the longitudinal cutter is stapled and can become a second book.

A folding apparatus is preferably connected to the outlet of the continuous web mixing device. Tabloid products can be finished by the use of the folding apparatus from the continuous web exiting the continuous web mixing device.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
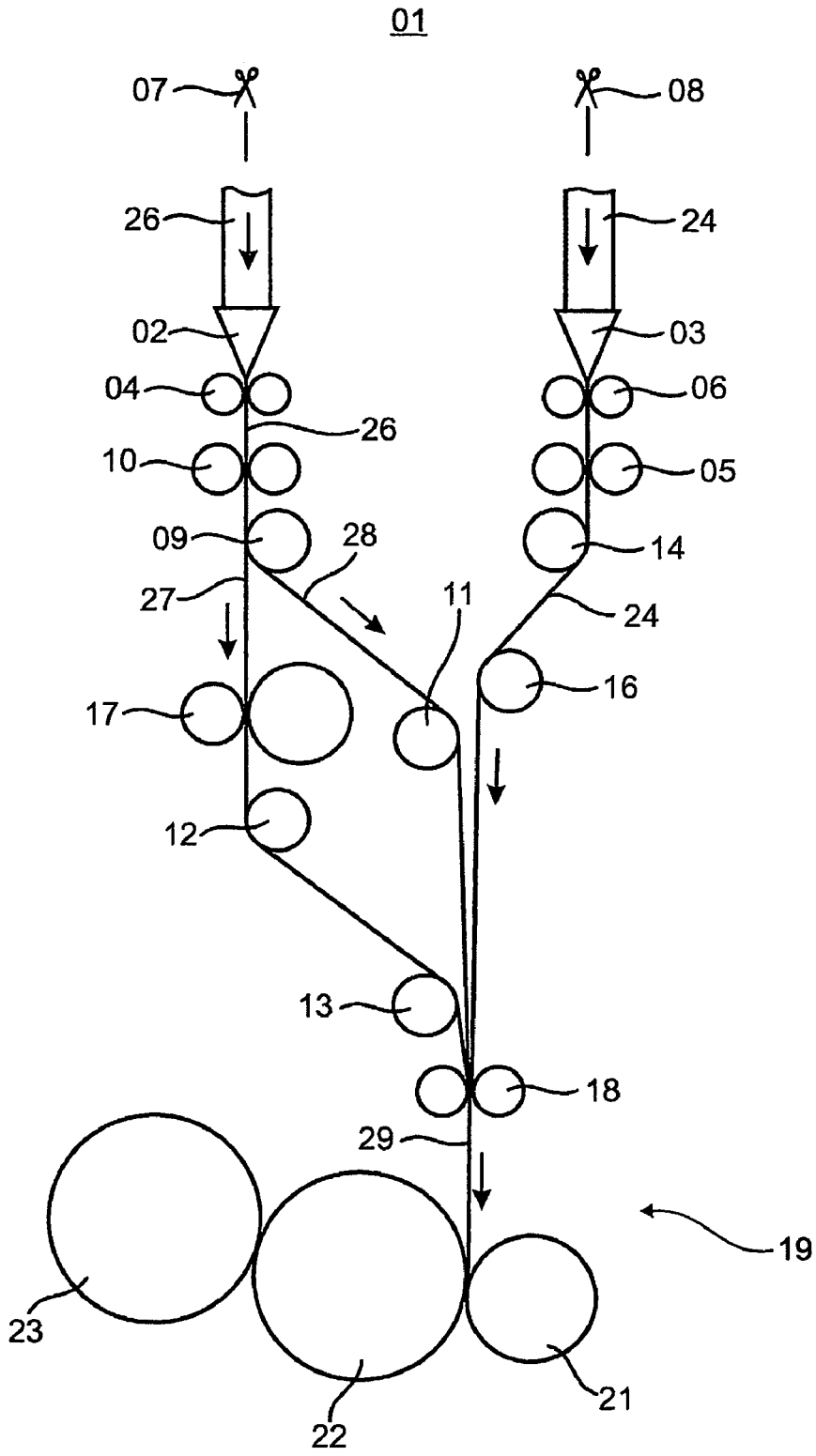
FIG. 1, a side elevation view of a first preferred embodiment of a continuous web mixing device in accordance with the present invention, in FIG. 2, a side elevation view of a second preferred embodiment of a continuous web mixing device, in FIG. 3, a side elevation view of a third preferred embodiment of a continuous web mixing device, in FIG. 4, side elevation view of a fourth preferred embodiment of a continuous web mixing device, and in FIG. 5A to 5M, product examples of folded products provided using the above-described preferred embodiments of the present invention.

A first preferred embodiment of a continuous web mixing device 01 in accordance with the present invention is represented in FIG. 1 and comprises two formers 02, 03, guide roller pairs 04, 06, 18, two longitudinal cutters 07, 08, deflection rollers 09, 11, 12, 13, 14, 16, two traction rollers 05, 10, as well as a stapler 17. A folding apparatus 19 is connected to the continuous web mixing device 01, which folding apparatus 19 comprises a cylinder 21, such as, for example, a cutting cylinder 21, a cylinder 22, such as, for example, a cutting groove, point and folding blade cylinder 22, as well as a cylinder 23, such as, for example, a folding jaw cylinder 23.

A first continuous web 24 is pulled through the former 03 in the direction of the draw-in arrow. The first continuous web 24 is constituted of a plurality of parallel running paper webs 24, which together are processed into tabloid products. In the course of their passage through the former 03, the longitudinally-cut, parallel running partial webs, running side-by-side over the former 03, are brought together. Following their passage over the former 03, the folded continuous web 24, which here is comprised of a plurality of partial webs placed on top of each other, runs over guide rollers 06 and terminates in one or both of the traction rollers 05, 10, or in one of the traction roller groups 05, 10. After passing through the former 03, the continuous web 24 therefore consists of twice the number of parallel extending paper webs 24 which paper webs 24, however, are of a lesser width than was the paper web 24 prior to its entry in the former 03. The continuous web 24 is conducted over the deflection rollers 14, 16 to the guide rollers 18 and leaves the continuous web mixing machine 01 via these guide rollers 18.

A different, second continuous web 26 is correspondingly conducted into the other former 02. This continuous web 26 also consists of a plurality of parallel extending individual paper webs which are assembled after having been longitudinally cut and moved apart. This continuous web 26 can be obtained, for example, together with the continuous web 24, by longitudinally cutting a double-width web which was previously imprinted in a printing press prior to its entry into the continuous web mixing device 01.

The partial webs of the second continuous web 26 are brought together in the associated former 02 and, after leaving the former 02, are fed via the guide rollers 04 to one or both of the traction rollers 10, 05. Leaving the traction roller or rollers 10, 05, the second continuous web 26 is conducted to the deflection roller 09 where, in contrast to the first continuous web 24, it is divided into two partial continuous webs 27, 28, such as, for example, partial paper webs 27, 28.

From the deflection roller 09, a first partial continuous web 28 is conducted, via the deflection roller 11, to the guide roller 18, i.e. to the outlet of the continuous web mixing device 01. It is combined there with the first continuous web 24. Since the continuous webs 24 and 26, or the continuous web 24 and the partial continuous webs 27, 28 are brought together in the area of the guide rollers 18, the place or location where they are brought together, in the area of the guide rollers 18, is called an outlet although, strictly structurally considered, this outlet or place of web combination can also be located further downstream with respect to the continuous web.

The second partial continuous web 27 runs from the deflection roller 09 to the stapler 17. The stapler 17 staples each of the paper webs 27, constituting the partial continuous web 27, before the second partial continuous web 27 enters the folding device 19, together along a line between two sides of the printed image generated on them, along which line a transverse fold will later be generated, in the course of the passage of the second partial continuous web 27 through the folding apparatus 19. After leaving the stapler 17 the second partial continuous web 27, now consisting of paper webs 27 stapled together in some places, is also conducted over the deflection rollers 12,13 to the guide roller 18 and is united there with the first partial continuous web 28, as well as with the first continuous web 24. In this way, a main continuous web 29, which is composed of the yet not stapled paper webs of the first continuous web 24, of the yet not stapled paper webs 28 of the first partial continuous web 28, and of the stapled paper webs 27 of the second partial continuous web 27, leaves the guide rollers 18 which, as discussed above, constitute the outlet from the continuous web mixing device 01.

This resultant main continuous web 29 now enters between the cutting cylinder 21 and the cutting groove, point and folding blade cylinder 22 of the folding apparatus 19. A folding jaw cylinder 23 follows the cutting groove, point and folding blade cylinder 22. The main continuous web 29 is cut, in a generally known manner, into individual products between the cylinders 21, 22 of the folding apparatus, which cut, individual products are subsequently transversely folded between the cylinders 22, 23. The tabloid products produced by the continuous web mixing device 01 depicted in FIG. 1 have an outer, not stapled layer and an inner, stapled layer.

It is possible, at the deflection roller 09, to distribute the individual paper webs consisting of the second continuous web 26 as desired, to form the two partial continuous webs 27, 28, and to provide the one paper web 26 corresponding respectively to four pages of the finished printed product, so that the change of the stapled layer into cuts of respectively four pages can be selected as desired.

The continuous web mixing device 01 is not limited to the specific embodiment represented in FIG. 1. For example, it is possible to modify the continuous web mixing device 01 in such a way that the stapler 17 is arranged in the guide path for the first partial continuous web 28, instead of being arranged in the guide path for the second partial continuous web 27. In that configuration, the paper webs constituting the first partial continuous web 28 are stapled together at predetermined locations by the stapler 17, while the paper webs 27 constituting the second partial continuous web 27 remain not stapled. After uniting the first and second partial continuous webs 27, 28 with the first continuous web 24, for formation into the main continuous web 29 at the outlet of the continuous web mixing device 01 at the guide rollers 18, and after passing the formed main continuous web 29 through the folding apparatus 19, tabloid products are produced by the alternative embodiment of the continuous web mixing device 01, which tabloid products have three layers, in which tabloid product an outer layer and an inner layer are not stapled, while a layer between these two layers is stapled.

The second continuous web 26 could, of course, also be conducted in one piece, possibly together with paper webs branched off from the first continuous web 24, through the stapler 17 if a larger size is desired for the stapled layer than for the one not stapled.

Depending on the width of the printing press which is arranged upstream of the continuous web mixing device 01, the continuous web mixing device 01 can also have more than two formers. The partial continuous web conducted through the stapler 17 can then be a part of a longitudinally cut continuous web coming from one of the formers, or can also constitute this continuous web in its entirety and can additionally contain paper webs from a continuous web coming from an adjoining former.

In another embodiment of the present invention, the longitudinal cutter or cutters 07, 08 is or are not arranged upstream of the respective former or formers 02, 03, but is or are located downstream of the respective former or formers 02, 03. In this case, the folded continuous web 29 is cut open at the folded spine downstream of the former 02, 03.

Figure 2:
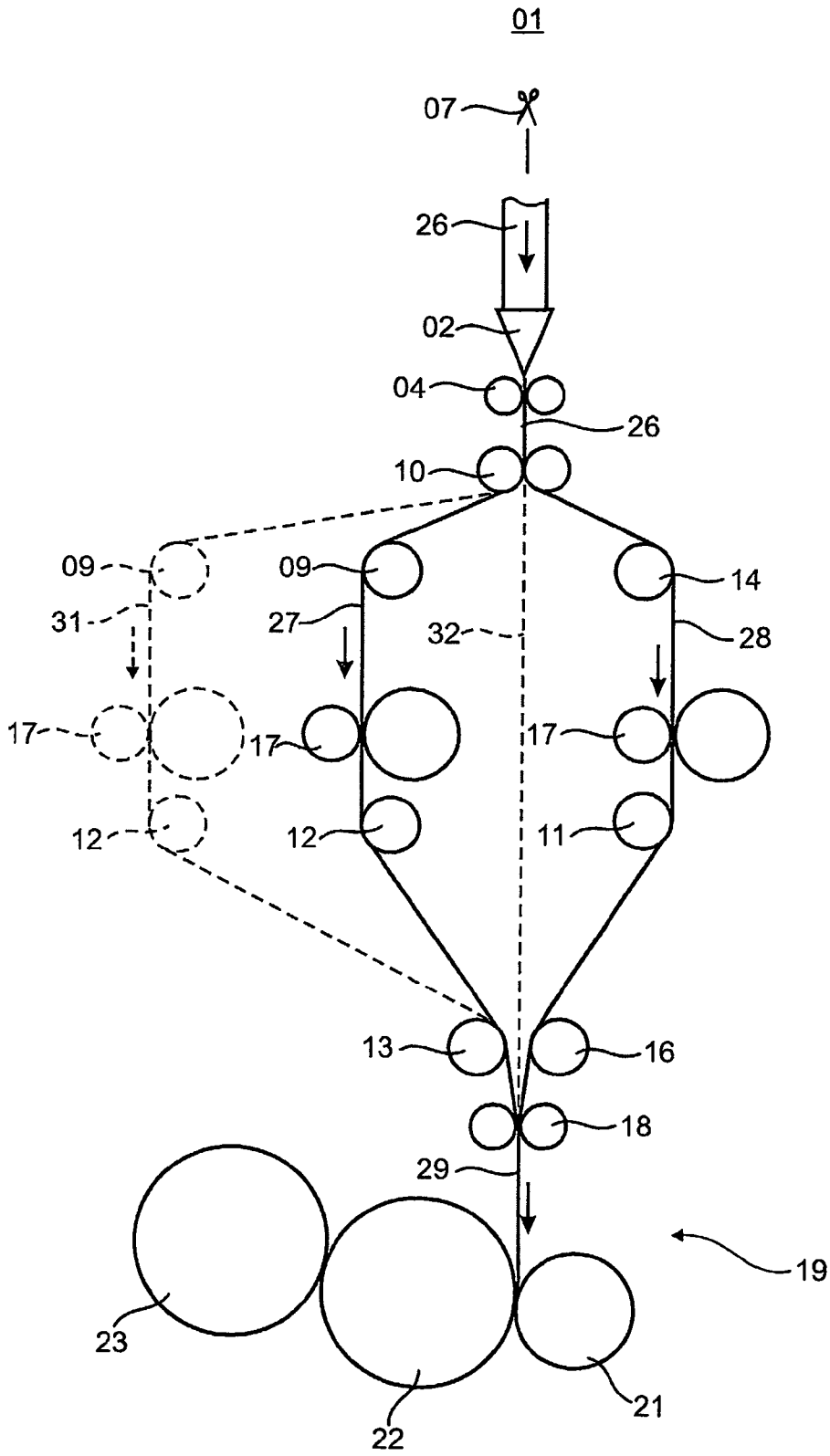

In an embodiment of the present invention, which is represented in FIG. 2, at least two continuous web guides of the first and second partial continuous webs 28 and 27 are assigned to a former 02 and to the continuous web 26 formed by this embodiment. For this purpose, the continuous web 26 is longitudinally cut, either upstream or downstream of the former 02, as mentioned above, and is then divided onto the continuous web guides of the first and second partial continuous webs 28 and 27. At least one of the continuous web guides, however, and in an advantageous manner both of the continuous web guides, here have a stapler 17 along their path. One or both of the partial continuous paper webs 27, 28 can be stapled before the partial paper webs 27, 28 are again combined into a product and are further processed in the folding apparatus 19.

As indicated in dashed lines in FIG. 2, a third partial continuous paper web 31 can also be conducted out of the continuous web 26 and can be stapled by the use of a possibly provided stapler 17, before it, too, is again combined to form the product 29. A continuous web guide is also shown in dashed lines in FIG. 2, wherein a fourth different partial continuous paper web 32 is conducted, for example without being rerouted and/or without being stapled, straight downward to the entry into the folding apparatus 19.

A particular advantage of the embodiment of the present invention, in accordance with FIG. 2, lies in that it is possible to considerably reduce the number of formers 02, 03 required in connection with the formation of several "books" of a product, which several books have been stapled separately of each other, or, in part, have not been stapled. For example, in connection with a similar variability of the product it is possible to save an additional former, such as a balloon former which would otherwise be arranged upstream of the former 02. Considerable construction costs and structural size can be saved by this elimination of one or more formers.

Figure 3:
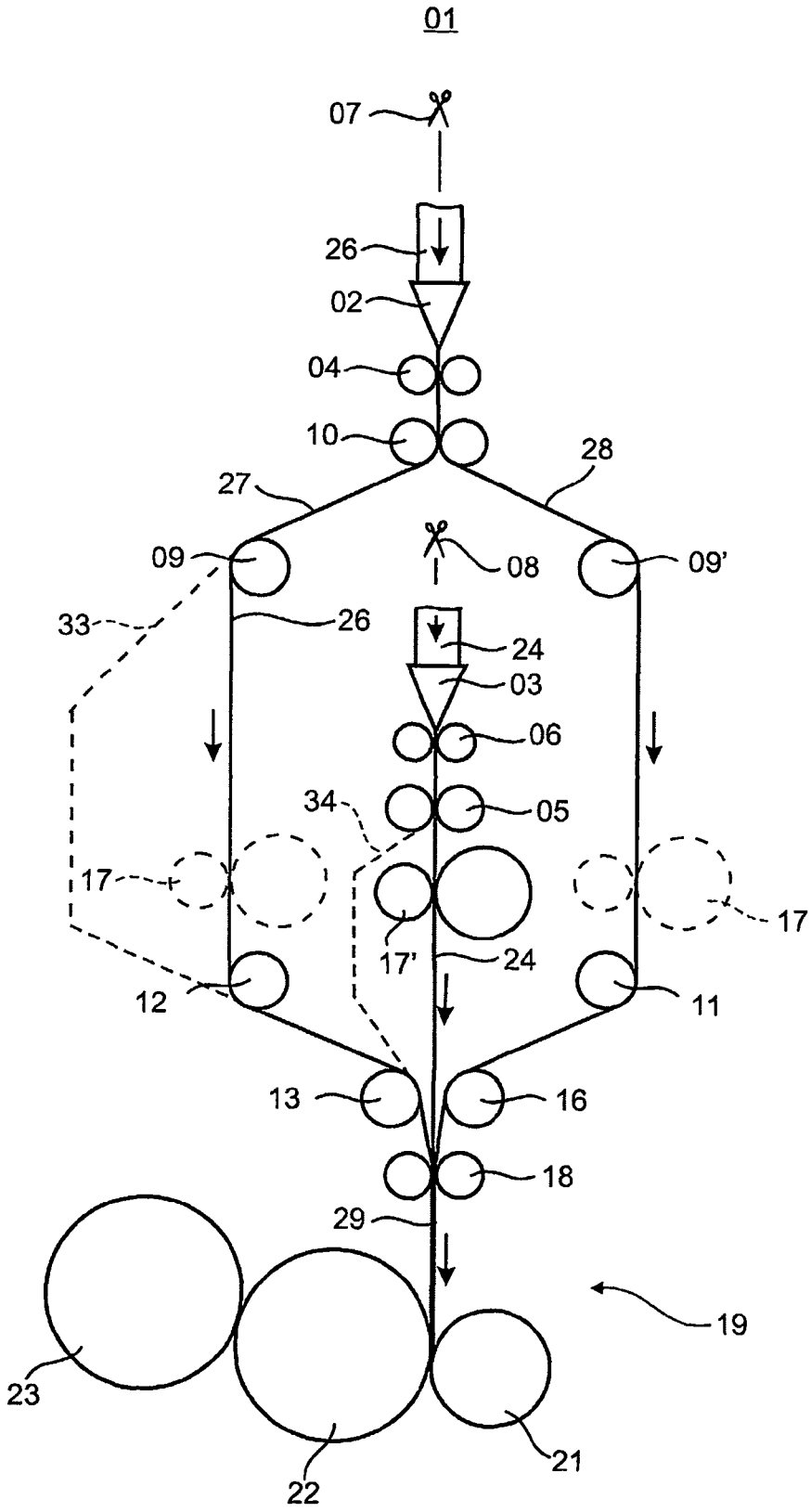

In a third preferred embodiment of the present invention, as seen in FIG. 3, the two partial continuous paper webs 27, 28 are conducted from the former 02 around both sides of a former 03 which former 03 is, for example, located underneath the former 02, via deflection rollers 09, 09'. As was discussed in connection with the first described embodiments, a stapler 17, which is represented by dashed lines, can be arranged on one of the two, or on both of the continuous web guides of the partial continuous paper webs 27, 28. Upstream of the folding apparatus 19, the two partial continuous paper webs 27, 28 are brought together with the continuous web 24 from the lower former 03, wherein the continuous web 24 comes to lie between the two partial continuous paper webs 27, 28. In an advantageous embodiment of the present invention, as seen in FIG. 3, a stapler 17' can be arranged in the path of the continuous web guide of the continuous web 24 in addition to, or in place of the stapler or staplers 17 shown in dashed lines in FIG. 3. In an embodiment of the invention, and which is distinguished by great flexibility, the continuous web guide of the continuous web 24, as well as at least one of the continuous web guides of the partial continuous paper webs 27, 28, which are moving around both sides of the former 03, each have a stapler 17, 17'. If it is desired to provide an even more variable production capability, the continuous web guides of the three continuous webs 24, 27, 28 each have a stapler 17, 17'.

Additional continuous bypass guides 33, 34, as indicated in dashed lines by way of example in FIG. 3, can be provided in all three of the discussed preferred embodiments, by the use of which, a portion of the, for example, again divided continuous web 24, 27, 28, or the entire continuous web 24, 27, 28 can be guided around a stapler 17, 17', which is located on a continuous guide, without being stapled. In connection with this, only two bypass continuous web guides 33, 34, which are schematically represented without deflection rollers, are shown in dashed lines in FIG. 3. However, these bypass continuous web guides 33, 34 can be optionally transferred, in a further development, to individual or to several continuous webs 24, 27, 28 from the above-described three preferred embodiments.

Figure 4:
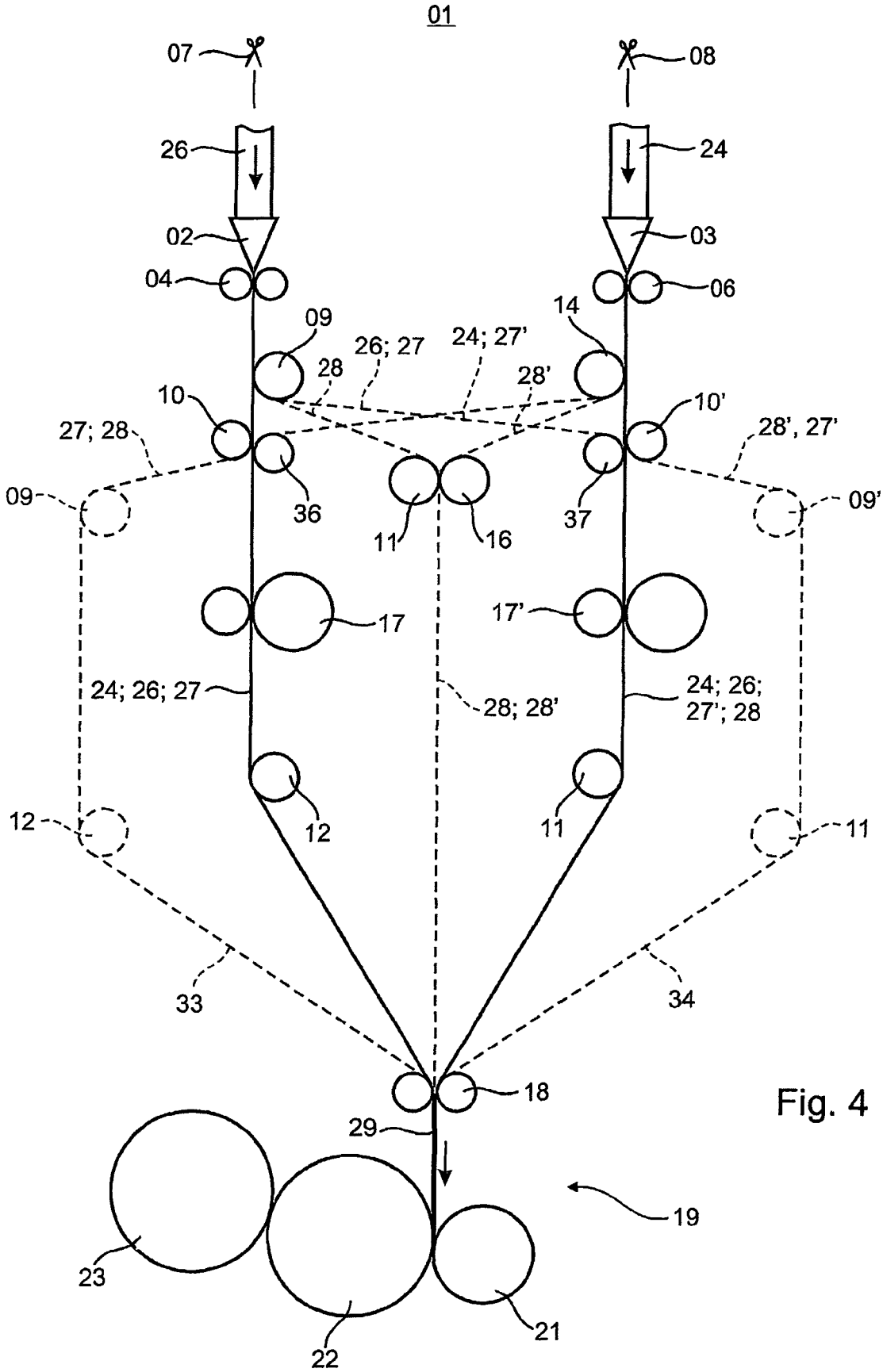

In a fourth preferred embodiment, as seen in FIG. 4, respectively one stapler 17, 17' is assigned to each of the two formers 02, 03, each former 02, 03 being provided with a longitudinal cutter 07, 08, in the guide path from the respective former 02, 03 to the outlet of the continuous web mixing device 01. The continuous web mixing device 01 here has deflection rollers 09, 14, 36, 37, via which deflection rollers one partial continuous paper web 28, or the entire continuous web 26 of the one former 02 can be passed, together with a partial continuous web 27', or with the entire continuous web 24 of this second former 03, 02, through the stapler 17' which is assigned to the second former 03, or, in an advantageous embodiment, the web is passed through it. Therefore, it is not necessary to determine the correct approach to a former which is already in a superstructure, which is not specifically represented, by turning partial webs. Instead, after passing through the formers 02, 03, the partial webs can still be assigned to the other partial continuous web 27', or to the continuous web 24. It is also possible to process all of the partial webs, such as the two folded and cut continuous webs 24, 26, into a product through one of the staplers 17', 17. In the same way, is it possible that a partial continuous paper web 28, together with a continuous web 24, or with a partial continuous paper web 27' of the other former 03, is stapled, while the remaining partial continuous paper web 27 of the first former 02 passes through the assigned stapler 17 without being stapled such as, for example, if i.e. the stapler is not switched on or is out of service. The arrangement discussed above with the above-mentioned reference numerals, is to be applied symmetrically to the opposite guide.

By the use of the above-mentioned guide paths over both of the depicted staplers 17, 17', a main continuous web 29, at the outlet of the mixing device 01, can be attained in a first mode of operation, which web 29 has a portion of one or several layers not stapled by passing through, for example, switched-off staplers 17, 17', and a portion with several layers stapled together, as is represented in FIG. 5*a* from the inside to the outside). In a second mode of operation, as seen in FIG. 5*b*, the main continuous web is constituted by two portions, each of which has several layers stapled together, and where the number of layers between the two portions can be variable by utilization of the above mentioned bypass.

In an advantageous manner, the continuous web mixing device 01 has further deflection rollers 11, 16, over which partial continuous paper webs 28, 28' of the one and/or of the other former 02, 03 is or are conducted without passing through one of the staplers 17, 17'. As seen in FIG. 4, these webs 28, 28' move along an appropriate guide path between the two staplers 17, 17'.

By the use of this, the above-mentioned modes of operation of the present invention, and the products resulting therefrom as the main, continuous web 29 can be expanded in such a way that, in a third mode of operation, an additional portion with one or with several layers, which are not stapled, is introduced, in addition to the previously mentioned sequences between the already mentioned portions, in particular as the two stapled portions of the second mode of operation, as seen in FIG. 5*c*. The number and origin of the layer or layers of this last mentioned portion is or are variable. It or they can come from one, from the other, or from both of the formers 02, 03.

Even more flexible, with regard to the product to be produced, the continuous web mixing device 01 can be embodied with additional deflection rollers 09, 09', 10, 10', 11, 12, all as seen in FIG. 4, over which additional deflection rollers a partial continuous web 27, 28, 27', 28', exiting from at least one of the formers 02, 03, can be conducted on an outside of the continuous web mixing device 01, around the two staplers 17, 17' to the outlet 18, without passing through one of the staplers 17, 17'. In FIG. 4, such an adjoining guide path, identified as bypass continuous web guide 33, 34, is provided for each of the two formers 02, 03. This makes it possible, in addition to the two first-mentioned modes of operation and also in addition to the third mode of operation, to add to the previously mentioned sequence of portions, a further portion with one or with several layers, which layers have not been stapled, and located on the one and/or on the other exterior continuous web side of the main continuous web 29 now obtained, or to actually add it. Thus, for example, in a fourth mode of operation in accordance with the present invention, a sequence of one unstapled portion, a stapled portion, an unstapled portion and a further stapled portion, as shown in FIG. 5*d*, and in a fifth mode of operation, an additional unstapled portion, as seen in FIG. 5*e*, is made possible or is provided. In a sixth mode of operation, as depicted in FIG. 5F, there is formed a sequence of an unstapled portion, a stapled portion and a second stapled portion, and in a seventh mode of operation an additional further unstapled portion, as seen in FIG. 5*g*, can be achieved or is produced.

The above-mentioned deflection rollers 09, 11, 12, 13, 14, 16, 36, 37 are preferably embodied as rollers 09, 11, 12, 13, 14, 16, and in particular are provided as friction-driven 09, 11,12,13,14, 16.

The main continuous web 29 is subsequently transversely cut in the folding apparatus 19, and the product sections obtained, as a result of this cutting are transversely folded, for example.

The transversely folded products, which can be obtained with the above-mentioned modes of operation, are represented, by way of example, in FIGS. 5*a* to 5*g*. In this case, the number of layers per portion, either stapled or not stapled, has been selected only as example. A number of layers in the portion can also be higher or lower than is represented. Different portions can have different numbers of layers. Particularly in connection with portions which are not stapled, the number of layers can also be 1. Stapling is indicated schematically in FIGS. 5*a*-5*m* by a line connecting the layers in the area of the folded spine.

Figure 5:
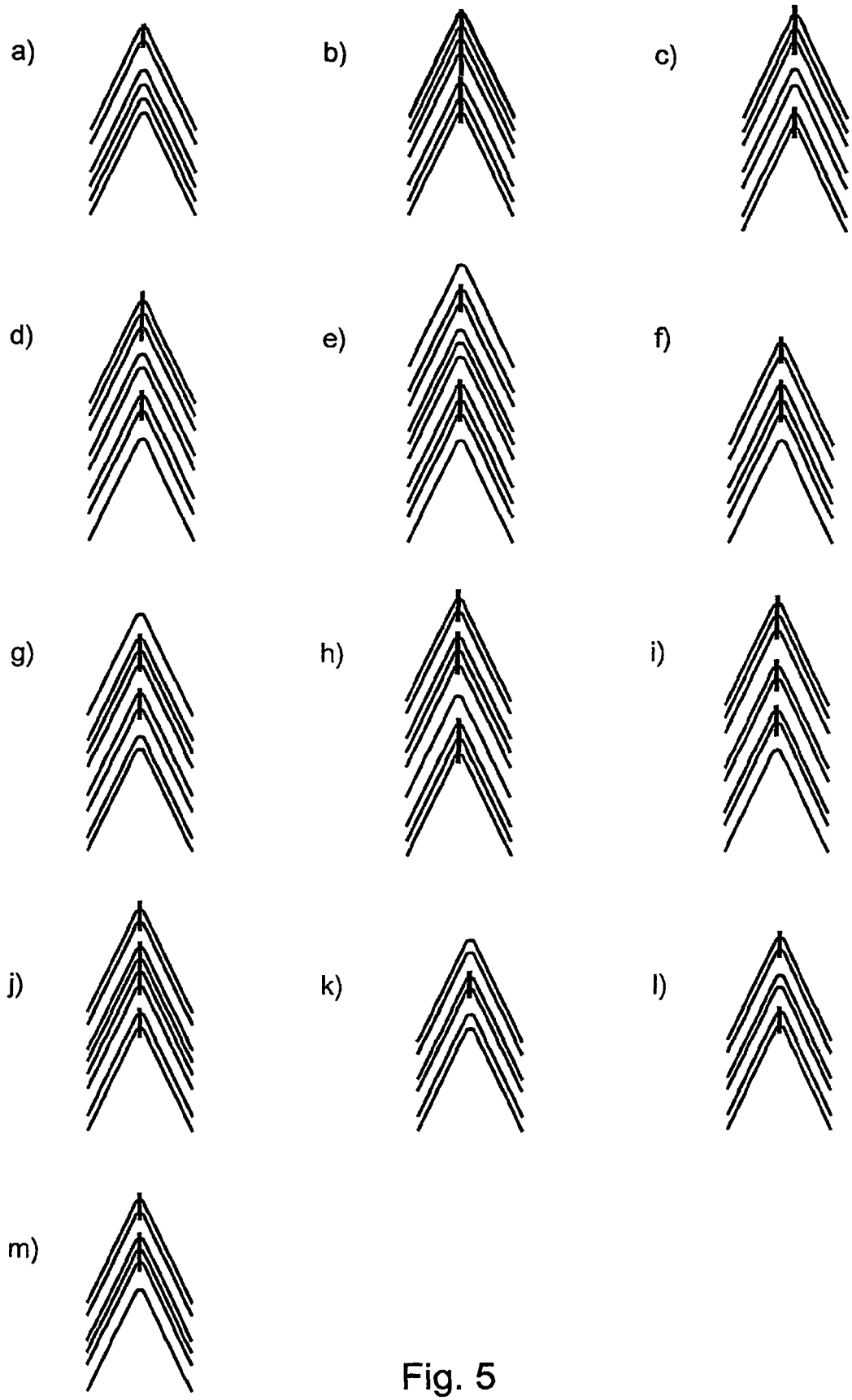

The products which can be obtained by the different modes of operation of the device in accordance with FIG. 1 are also represented in FIG. 5. FIG. 5*a* shows a product which results where bypassing of a partial continuous paper web 28, which is not intended to be stapled, takes place.

The products produced by different modes of operation of the device in accordance with FIG. 2 can also be seen from FIG. 5, but not exhaustively. For example, the product in accordance with FIG. 5*a* with one stapler switched off and FIG. 5*b* with only the partial continuous paper webs 27, 28 shown in solid lines, can be produced. The arrangement shown in FIG. 5*c* can be produced without taking a guidance of the partial continuous paper web 31 into consideration, such as is provided in a basic version of the second embodiment in accordance with FIG. 2, but with a possibility of the partial continuous paper web 32. With a left stapler 17 provided, with the center stapler 17 switched off or non-existent, as well as with the right stapler 17 turned on, the configuration shown in FIG. 5*c* can also be achieved with the partial continuous web 31, without guidance of the partial continuous web 32. With the center stapler 17 additionally turned on, the configuration of FIG. 5*j* can be achieved. If, however, the left stapler 17 is not provided or is instead switched off, the configuration of FIG. 5*m* can be realized. FIG. 5*h* shows a possible product created by the use of all drawn in guides and with the three staplers 17 all turned on.

In addition to the products shown in FIGS. 5*a* to 5*g*, and mentioned in the portion of the specification in connection with FIG. 4, but to be transferred to operating situations with selectively switched-off or not provided staplers 17, 17', or with used or unused bypasses 33, 34, a product in accordance with FIG. 5*i* is possible with use of the device in accordance with FIG. 3 taking the bypass 33 and three staplers 17, 17' into consideration, and without the bypass 33, but with the bypass 34, the reverse of the product shown in FIG. 5*h*. If all three continuous webs or partial continuous webs 24, 27, 28, drawn in solid lines, have a stapler 17, 17', the product in accordance with FIG. 5*j* can be produced from three portions without a further bypass 33, 34. If a stapler 17' is only provided for the continuous web 24, or selectively only this one of the two or three staplers 17, 17' is switched on, a product in accordance with FIG. 5*k* results.

The product sequence in the representation from the inside to the outside can be reversed, either by an appropriate guidance through the continuous web mixing device 01, or by changing the folding apparatus 19.

It is of particular advantage that, as a rule, the above-mentioned products can be made, at least to a large extent, without turning, and in particular without previous turning of partial webs in a superstructure upstream of the formers 02, 03. The partial webs to be assigned to one or to the other continuous web, or the partial continuous web 24, 27, 28, are transferred to the desired location in the continuous web mixing device 01.

While preferred embodiments of a sheet combining device and a method for combining sheets, in accordance with the present invention, have been set forth fully and completely hereinabove, it will be apparent to one of skill in the art that various changes in, for example, the type of printing press used to print the web, the specific drives for the various rollers and cylinders, and the like could be made without departing from the true spirit and scope of the present invention which is accordingly to be limited only by the appended claims.

What is claimed is:

1. A continuous web mixing device comprising:

a first former;

a first longitudinal cutting device associated with said first former and adapted to cut a first continuous web, constituted of a first plurality of parallel webs into first and second cut partial first continuous webs each constituted of said first plurality of parallel webs;

at least one first former guide path;

a first stapler associated with said first former guide path;

a second former;

a second longitudinal cutting device associated with said second former, and adapted to cut a second continuous web, constituted of a second plurality of parallel webs into first and second cut partial second continuous webs each constituted of said second plurality of said parallel web;

at least one second former guide path;

a second stapler associated with said second former guide path;

an outlet for said continuous web mixing device; and at least a first deflection roller intermediate said first and second formers and said outlet, one of said first continuous web and of said first and second ones of said first and second cut partial continuous webs, each associated with its separate one of said first and second formers, being conducted through said one of said first and second staplers which is associated with the other of said first and second formers together with one of said second continuous web and of said first and second ones of said first and second cut partial continuous webs associated with the other one of said first and second formers.

2. The continuous web mixing device of claim 1 further including a second deflection roller adapted to conduct at least one of said first and second cut partial first and second continuous webs and of said first and second continuous webs from said first and second formers to said outlet and not passing through one of said first and second staplers.

3. The continuous web mixing device of claim 1 further including a second deflection roller adapted to guide one of said first and second cut partial continuous first and second continuous webs around said first and second stapler and along an outside of said continuous web mixing device.

* * * * *